US012055000B2

(12) United States Patent
Xu et al.

(10) Patent No.: US 12,055,000 B2
(45) Date of Patent: Aug. 6, 2024

(54) LINER/CASING BUOYANCY ARRANGEMENT, METHOD AND SYSTEM

(71) Applicants: YingQing Xu, Tomball, TX (US); Zhiyue Xu, Cypress, TX (US); Zhihui Zhang, Katy, TX (US)

(72) Inventors: YingQing Xu, Tomball, TX (US); Zhiyue Xu, Cypress, TX (US); Zhihui Zhang, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 218 days.

(21) Appl. No.: 17/563,541

(22) Filed: Dec. 28, 2021

(65) Prior Publication Data

US 2023/0203894 A1 Jun. 29, 2023

(51) Int. Cl.

| | |
|---|---|
| ***E21B 33/12*** | (2006.01) |
| ***E21B 17/10*** | (2006.01) |
| ***E21B 33/124*** | (2006.01) |

(52) U.S. Cl.

CPC ..... *E21B 17/1078* (2013.01); *E21B 33/12* (2013.01); *E21B 33/124* (2013.01); *E21B 2200/08* (2020.05)

(58) Field of Classification Search

CPC ..... E21B 33/12; E21B 33/124

See application file for complete search history.

(56) References Cited

U.S. PATENT DOCUMENTS

| | | | | |
|---|---|---|---|---|
| 4,986,361 | A | 1/1991 | Mueller et al. | |
| 5,117,915 | A | 6/1992 | Mueller et al. | |
| 5,181,571 | A | 1/1993 | Mueller et al. | |
| 5,456,317 | A | 10/1995 | Hood, III et al. | |
| 5,669,448 | A * | 9/1997 | Minthorn | E21B 33/12 166/308.1 |
| 5,829,526 | A | 11/1998 | Rogers et al. | |
| 6,505,685 | B1 | 1/2003 | Sullaway et al. | |
| 6,622,798 | B1 | 9/2003 | Rogers et al. | |
| 7,357,181 | B2 | 4/2008 | Webb et al. | |
| 7,533,729 | B2 | 5/2009 | Rogers et al. | |
| 7,712,521 | B2 | 5/2010 | Sorensen | |

(Continued)

FOREIGN PATENT DOCUMENTS

| | | |
|---|---|---|
| WO | 2019164632 A1 | 8/2019 |
| WO | 2021167643 A1 | 8/2021 |

OTHER PUBLICATIONS

Airlock Casing Buoyancy System; NCS Multi Stage, 2015, 2 pages.

(Continued)

*Primary Examiner* — Giovanna Wright

(74) *Attorney, Agent, or Firm* — CANTOR COLBURN LLP

(57) ABSTRACT

A casing/liner string buoyancy arrangement including a casing/liner string, and a material defining a volume disposed within the string, the material excluding downhole fluids from the volume, the volume being of a lower specific gravity than the same downhole fluids. A method for managing buoyancy of a casing/liner string including configuring a casing/liner string, running the string, and selectively maintaining or degrading the material to adjust buoyancy of the string. A borehole system including a borehole in a subsurface formation, and an arrangement disposed in the borehole.

18 Claims, 3 Drawing Sheets

(56) References Cited

U.S. PATENT DOCUMENTS

| | | | | |
|---|---|---|---|---|
| 7,806,189 | B2 | 10/2010 | Frazier | |
| 8,322,448 | B2 | 12/2012 | Brandsdal | |
| 9,033,055 | B2 | 5/2015 | McCoy et al. | |
| 9,500,061 | B2 | 11/2016 | Frazier et al. | |
| 9,593,542 | B2 | 3/2017 | Getzlaf et al. | |
| 9,739,114 | B2 | 8/2017 | Frazier | |
| 10,465,445 | B2 | 11/2019 | Getzlaf et al. | |
| 10,655,413 | B2 | 5/2020 | Brandsdal et al. | |
| 10,871,053 | B2 | 12/2020 | Frazier | |
| 10,883,314 | B2 | 1/2021 | Getzlaf et al. | |
| 10,883,315 | B2 | 1/2021 | Getzlaf et al. | |
| 10,883,328 | B2 | 1/2021 | Brandsdal | |
| 10,934,802 | B2 | 3/2021 | Brandsdal | |
| 11,098,556 | B2 | 8/2021 | Frazier | |
| 2008/0185157 | A1 | 8/2008 | Jordan et al. | |
| 2013/0025849 | A1 | 1/2013 | Richard et al. | |
| 2014/0000906 | A1* | 1/2014 | Williamson | E21B 43/10 166/212 |
| 2014/0345878 | A1 | 11/2014 | Murphree et al. | |
| 2016/0333658 | A1 | 11/2016 | Keshishian et al. | |
| 2017/0081939 | A1 | 3/2017 | Bishop et al. | |
| 2017/0284167 | A1 | 10/2017 | Takahashi et al. | |
| 2018/0051533 | A1 | 2/2018 | Zbranek et al. | |
| 2018/0112487 | A1 | 4/2018 | Budde et al. | |
| 2019/0093448 | A1 | 3/2019 | Rochen et al. | |
| 2019/0112887 | A1 | 4/2019 | Xu et al. | |
| 2020/0332601 | A1 | 10/2020 | Getzlaf et al. | |
| 2021/0115735 | A1 | 4/2021 | Getzlaf et al. | |
| 2021/0131221 | A1 | 5/2021 | Helms et al. | |
| 2021/0140262 | A1* | 5/2021 | Yuan | E21B 33/12 |
| 2021/0230970 | A1* | 7/2021 | Yuan | E21B 43/10 |
| 2021/0238942 | A1* | 8/2021 | Stratton | E21B 33/13 |
| 2021/0324701 | A1 | 10/2021 | Lewis et al. | |
| 2021/0332667 | A1 | 10/2021 | Dharne et al. | |
| 2022/0275709 | A1* | 9/2022 | Glaser | E21B 41/0035 |
| 2022/0333458 | A1 | 10/2022 | Laun | |
| 2023/0203893 | A1 | 6/2023 | Xu et al. | |

OTHER PUBLICATIONS

Breakthru Casing Flotation Device, 9 Energy Service: Retrieved from: https://nineenergyservice.com/cementing-drilling-solutions/breakthru-casing-flotation-device, 2018.

Notification of Transmittal of the International Search Report and the Written Opinion of the International Searching Authority, or the Declaration; PCT/2022/052950; Mail date: Apr. 20, 2023; 9 pages.

Notification of Transmittal of the International Search Report and the Written Opinion of the International Searching Authority, or the Declaration; PCT/US2022-052949; mail date: Apr. 20, 2023; 7 pages.

* cited by examiner

LINER/CASING BUOYANCY ARRANGEMENT, METHOD AND SYSTEM

BACKGROUND

In the resource recovery industry liners and casings are often disposed in boreholes as part of a completion operation. When a borehole is vertical this is relatively easy in that the casing is urged by gravity to penetrate the borehole. When boreholes are highly deviated of horizontal however, running a casing therein becomes more difficult since the same gravitational force that helped in the vertical section will cause the casing to drag against the low side wall of the borehole making friction a complicating factor for running the casing string. To alleviate the issue, the art has used plugs in the casing string to trap air therein thereby taking advantage of the buoyancy effect of the less dense air relative to the denser mud and "floating" the casing. This reduces the problem in the first instance but then creates its own problems since the plugs must somehow be removed. Various methods have been tried but the art is always receptive to more efficient arrangements.

SUMMARY

An embodiment of a casing/liner string buoyancy arrangement including a casing/liner string, and a material defining a volume disposed within the string, the material excluding downhole fluids from the volume, the volume being of a lower specific gravity than the same downhole fluids.

An embodiment of a method for managing buoyancy of a casing/liner string including configuring a casing/liner string, running the string, and selectively maintaining or degrading the material to adjust buoyancy of the string.

An embodiment of a borehole system including a borehole in a subsurface formation, and an arrangement disposed in the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
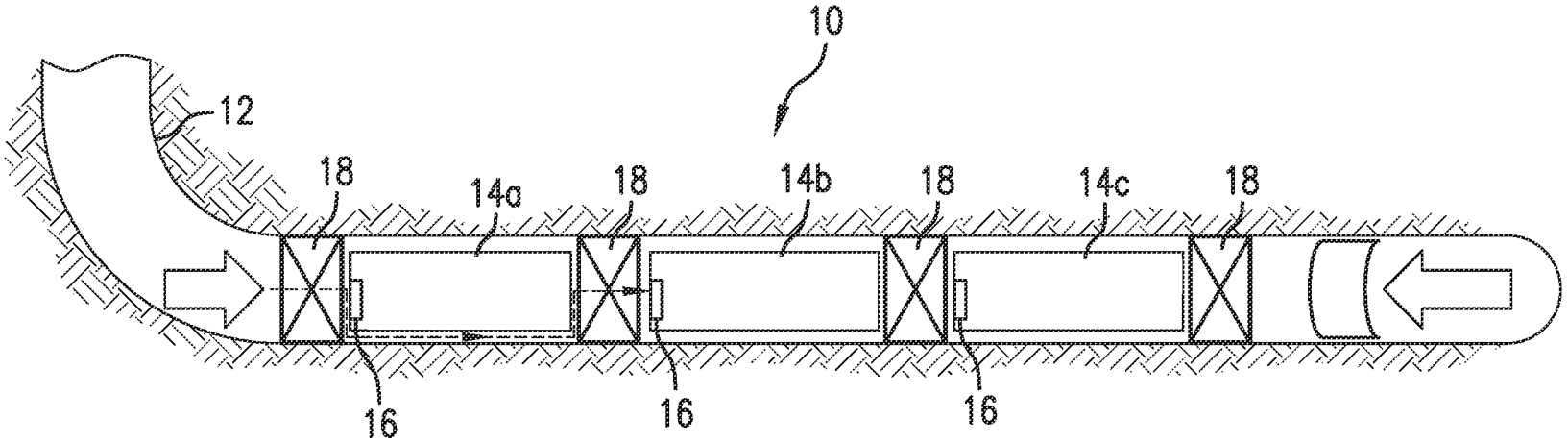
FIGS. 1 and 2 are a schematic views of a casing/liner buoyancy arrangement as disclosed herein in different states.
Figure 2:
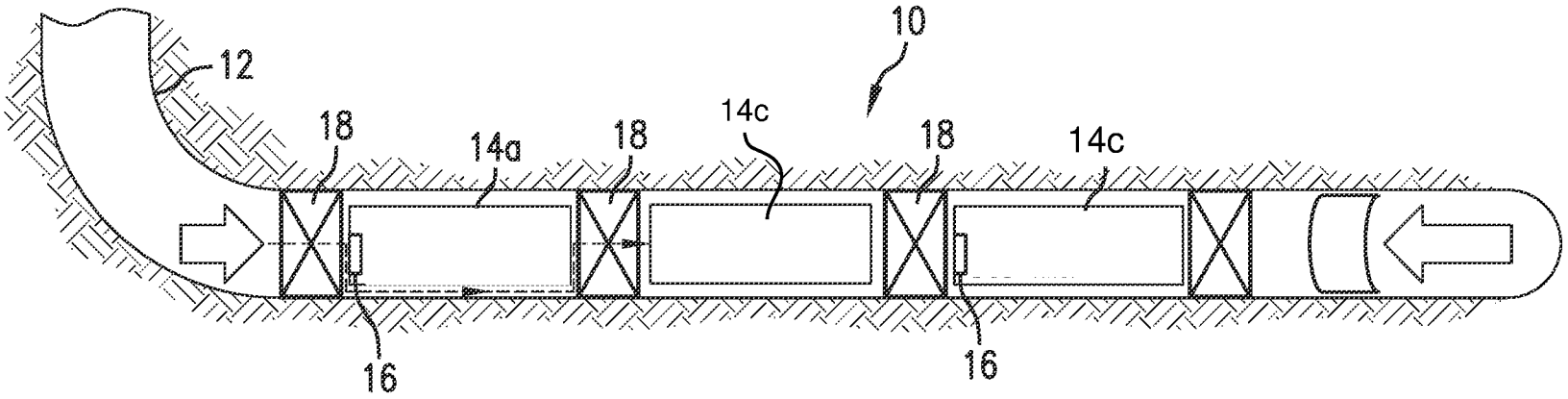

Referring to FIGS. 1 and 2, a casing/liner string buoyancy arrangement 10 is illustrated. Arrangement 10 includes a casing/liner string 12 and a material 14 defining a volume disposed within the string, the material (a solid, a closed cell foam, or even an open cell foam having pore sizes in the sub-micrometer range such that the hydrostatic pressure would be resisted are contemplated) excluding downhole fluids from the volume, the volume being of a lower density than downhole fluids. As illustrated, three volumes of material (14*a*, 14*b*, and 14*c*) are apparent but it is to be understood that two volumes or one volume or more than three volumes are also contemplated. Further, longer volumes are also contemplated including the entire string in length. The material 14 is, as noted above, one that will exclude downhole fluids and have a density less than that of the downhole fluids. This results in a buoyant property of the material relative to downhole fluids. Further, the material 14 is removable through degradation in some rapid way (hours rather than days) and in one embodiment a disappear-on-demand (DOD) material is the material 14 selected. DOD material is commercially available from Baker Hughes, Houston, Texas and hence requires no particular disclosure herein. DOD material will rapidly degrade and disappear based upon a trigger 16 such as an igniter (electrical trigger, fluid pill trigger, exposure to ambient fluid trigger, etc.). Each of the material volumes 14*a*, 14*b*, 14*c* are individually addressable such that any of them can be triggered at any desired time and in any desired order. In such embodiment it is not necessary to seal off fluid around the material and that condition is what makes it possible to have for example a middle material 14*b* be triggered before that of 14*a* or 14*c* see FIG. 2 where downhole fluids have taken the place of the material 14*b* after triggering and disappearing on demand. The downhole fluids surrounding the arrangement flow into the volume of the disappeared material 14*b* simply because there will no longer be an impediment to fluid occupying that space (i.e., the material 14 is no longer occupying that volume). In the condition of FIG. 2, the buoyancy of the arrangement will be less than it is in FIG. 1 since one of the lower density volumes is now filled with downhole fluid and does not have lower density. 14*a* and 14*c* may then also be disappeared, as desired. It should be appreciated that any number of volumes of material 14 may be disappeared simultaneously or sequentially or in any other combination.

It is also contemplated in FIGS. 1 and 2 that the volumes of material 14 be secured in place in the string 12 by an anchor or securement 18. This may be accomplished using an interference fit, an adhesive, an anchoring arrangement, such as a set of slips and a cone, or separator any of which may also comprise degradable or Disappear-on-Demand material. The securements 18 may be adjacent longitudinal ends of materials 14*a-c* or may be a part of materials 14*a-c* or may be positioned radially of materials 14*a-c* as long as the material 14*a-c* is secured in position and not free to float away from position during movement of string 12. The securement 18 of any of the types noted above is represented schematically in FIGS. 1 and 2. In some embodiments, it may also be desirable to cause the securements 18 to also create fluid seals and this may be easily accomplished by disposing an o-ring or similar seal between an outer periphery of the securement 18 and the inside surface of the string 12.

Figure 3:
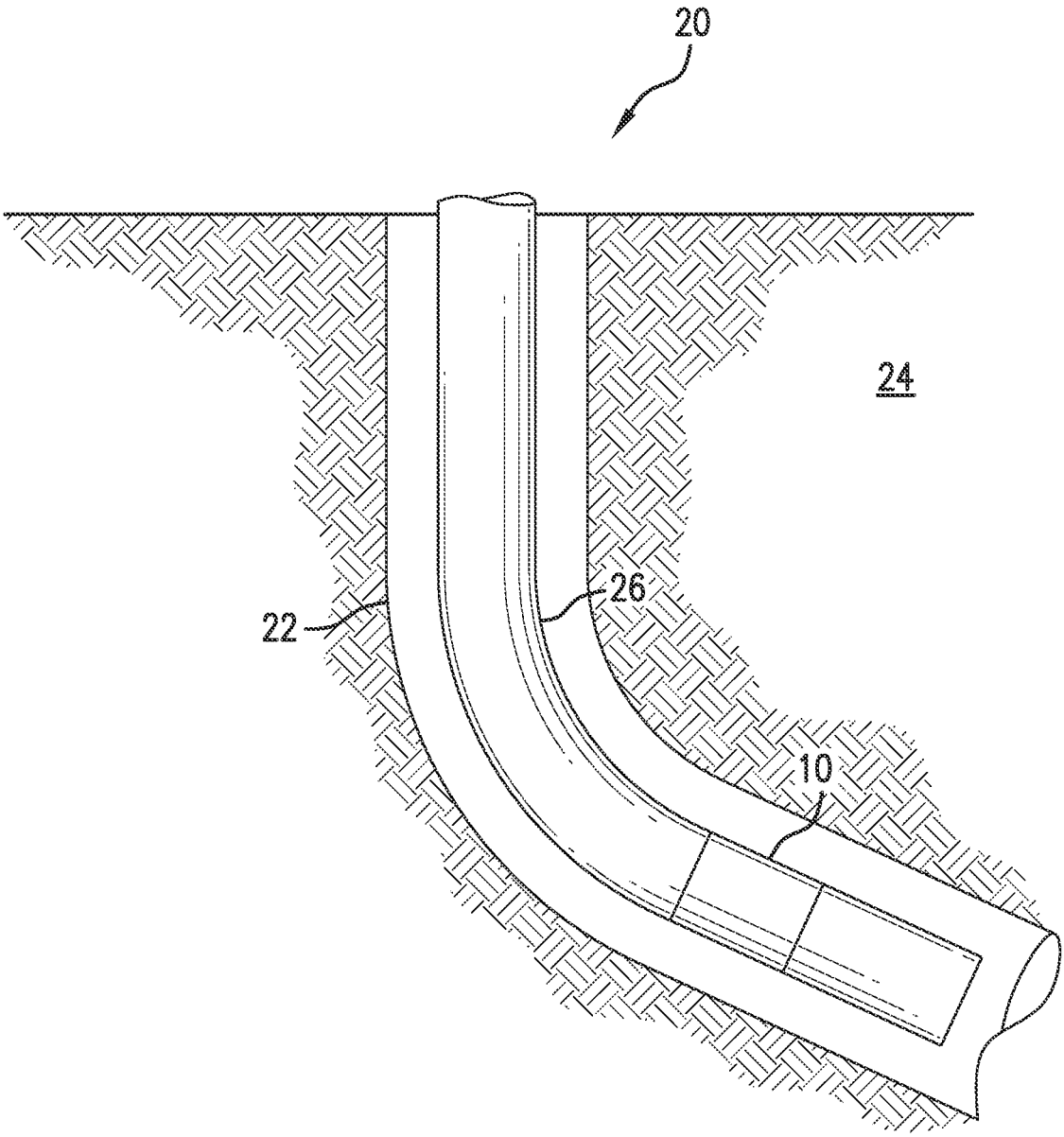
FIG. 3 is a view of a borehole system including the casing/liner buoyancy arrangement disclosed herein

Referring to FIG. 3, a borehole system 20 includes a borehole 22 in a subsurface formation 24. A string 26 is disposed in the borehole 22. A ca buoyancy arrangement 10 disposed within or as a part of the string 26.

Set forth below are some embodiments of the foregoing disclosure:

Embodiment 1: A casing/liner string buoyancy arrangement including a casing/liner string, and a material defining a volume disposed within the string, the material excluding downhole fluids from the volume, the volume being of a lower specific gravity than the same downhole fluids.

Embodiment 2: The arrangement as in any prior embodiment, wherein the material is a degradable material.

Embodiment 3: The arrangement as in any prior embodiment wherein the degradable material is a disappear-on-demand material.

Embodiment 4: The arrangement as in any prior embodiment, wherein the material is alterable via signal to stop excluding downhole fluids from the volume.

Embodiment 5: The arrangement as in any prior embodiment, wherein the material is a plurality of individual volumes of the material.

Embodiment 6: The arrangement as in any prior embodiment, wherein the material wherein the individual volumes are individually addressable.

Embodiment 7: The arrangement as in any prior embodiment, wherein the material is a solid.

Embodiment 8: The arrangement as in any prior embodiment, wherein the material is a foam.

Embodiment 9: The arrangement as in any prior embodiment, wherein the foam is closed cell.

Embodiment 10: The arrangement as in any prior embodiment, further comprising an anchor or securement to maintain position of the material in the string.

Embodiment 11: The arrangement as in any prior embodiment, wherein the anchor is a separator plug disposed in the string adjacent an end of the material.

Embodiment 12: The arrangement as claimed in claim 11, wherein the separator includes a seal.

Embodiment 13: The arrangement as in any prior embodiment, wherein the material is disposed between adjacent separators.

Embodiment 14: The arrangement as in any prior embodiment, wherein the separator is disappear-on-demand material.

Embodiment 15: The arrangement as in any prior embodiment, wherein the anchor is an interference fit of the material in the string.

Embodiment 16: The arrangement as in any prior embodiment, wherein the anchor is an adhesive.

Embodiment 17: A method for managing buoyancy of a casing/liner string arrangement including configuring a casing/liner string as in any prior embodiment, running the string, and selectively maintaining or degrading the material to adjust buoyancy of the string.

Embodiment 18: The method as in any prior embodiment wherein the selectively maintaining or degrading is selecting among a plurality of volumes of material and taking the stated action for each one of the plurality of volumes.

Embodiment 19: A borehole system including a borehole in a subsurface formation, and an arrangement as in any prior embodiment disposed in the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A casing/liner string buoyancy arrangement comprising:

a casing/liner string; and a degrade-on-demand material defining a discrete volume, that volume of material being placed within the string, the material excluding downhole fluids from its own volume, the material being of a lower specific gravity than the downhole fluids excluded thereby, wherein the material is surrounded by downhole fluids at all times during use.

2. The arrangement as claimed in claim 1 wherein the degradable material is a disappear-on-demand material.

3. The arrangement as claimed in claim 1, wherein the material is alterable via signal to stop excluding downhole fluids from the volume.

4. The arrangement as claimed in claim 1, wherein the material is a solid.

5. The arrangement as claimed in claim 1, wherein the material is a foam.

6. The arrangement as claimed in claim 5, wherein the foam is closed cell.

7. The arrangement as claimed in claim 1, further comprising an anchor or securement to maintain position of the material in the string.

8. The arrangement as claimed in claim 7, wherein the anchor is a separator plug disposed in the string adjacent an end of the material.

9. The arrangement as claimed in claim 8, wherein the separator includes a seal.

10. The arrangement as claimed in claim 8, wherein the separator is disappear-on-demand material.

11. The arrangement as claimed in claim 7, wherein the material is disposed between adjacent separators.

12. The arrangement as claimed in claim 7, wherein the anchor is an interference fit of the material in the string.

13. The arrangement as claimed in claim 7, wherein the anchor is an adhesive.

14. A borehole system comprising:

a borehole in a subsurface formation; and an arrangement as claimed in claim 1 disposed in the borehole.

15. A casing/liner string buoyancy arrangement comprising:

a casing/liner string; and a degrade-on-demand material defining a discrete volume, that volume of material being placed within the string, the material excluding downhole fluids from its own volume, the material being of a lower specific gravity than the downhole fluids excluded thereby, wherein the material is a plurality of individual volumes of the material.

16. The arrangement as claimed in claim 15, wherein the plurality of individual volumes are individually addressable.

17. A method for managing buoyance of a casing/liner string arrangement comprising:

configuring a casing/liner string with a casing/liner string buoyancy arrangement comprising:

a casing/liner string; and a degrade-on-demand material defining a discrete volume, that volume of material being placed with the string, the material excluding downhole fluids from its own volume, the material being of a lower specific gravity than the downhole fluids excluded thereby, running the string; and selectively maintaining or degrading the material to adjust buoyancy of the string, wherein the selectively maintaining or degrading is selecting among a plurality of volumes of material and taking the stated action for each one of the plurality of volumes.

18. A method for managing buoyancy of a casing/liner string arrangement comprising:

configuring a casing/liner string comprising:

a casing/liner string; and a material defining a volume disposed within the string, the material excluding downhole fluids from the volume, the volume being of a lower specific gravity than the same downhole fluids;

running the string; and selectively maintaining or degrading the material to adjust buoyancy of the string, wherein the selectively maintaining or degrading is selecting among a plurality of volumes of material and taking the stated action for each one of the plurality of volumes.

* * * * *